US005979213A

United States Patent [19]

Toyoda

[11] Patent Number: 5,979,213

[45] Date of Patent: Nov. 9, 1999

[54] PNEUMATIC DEVICE

[75] Inventor: Yukihiro Toyoda, Honjo, Japan

[73] Assignee: Meiho Co., Ltd, Tokyo, Japan

[21] Appl. No.: 09/038,291

[22] Filed: Mar. 11, 1998

[30] Foreign Application Priority Data

Apr. 3, 1997 [JP] Japan ..... 9-084876

[51] Int. Cl.[6] ..... B21F 1/00; B21D 39/00

[52] U.S. Cl. ..... 72/409.02; 72/453.16; 29/243.56; 140/93 D

[58] Field of Search ..... 72/453.16, 453.15, 72/453.18, 409.03, 409.02; 140/93 D; 29/243.56

[56] References Cited

U.S. PATENT DOCUMENTS

| | | | |
|---|---|---|---|
| 2,187,110 | 1/1940 | Champayne | 72/453.16 |
| 2,396,562 | 3/1946 | Forss | 140/93 D |
| 3,263,481 | 8/1966 | Boyd | 72/453.16 |
| 4,187,708 | 2/1980 | Champoux | 72/453.16 |
| 5,709,124 | 1/1998 | Murayama | 227/120 |

*Primary Examiner*—Daniel C. Crane

*Attorney, Agent, or Firm*—Birch, Stewart, Kolasch & Birch, LLP

[57] ABSTRACT

A hand-held pneumatic device, such as a C ring clamping device, comprises a main body, a grip joined to a lower portion of the main body, a pneumatic cylinder contained in the main body, and a directional control valve contained in the main body. A first air discharge passage formed in the grip is connected to a first discharge port of the directional control valve and has an open end in a lower end portion of the grip. A second air discharge passage formed in the main body is connected to a second discharge port of the directional control valve and has an open end opening in a back portion of the main body. The open end of the second air discharge passage is connected to an inner portion of the first air discharge passage, near the first discharge port of the directional control valve, so that air is discharged through the open end of the first air discharge passage.

6 Claims, 3 Drawing Sheets

PNEUMATIC DEVICE

BACKGROUND OF THE INVENTION

1. Field of the Invention

The present invention relates to a hand-held pneumatic device worked by compressed air, and more specifically to a hog ring clamping device, such as a C ring clamping device.

2. Description of the Prior Art

A conventional C ring clamping device has a main body and a grip joined to a lower portion of the main body. The main body is provided with a pneumatic cylinder for turning jaws, and a push-button directional control valve. An air discharge passage connected to a discharge port of the directional control valve is formed in the grip so as to open at the lower portion of the grip. Another air discharge passage connected to another discharge port of the directional control valve is formed in the main body so as to open in a back portion of the main body.

Air discharged from the port of the pneumatic cylinder is discharged outside through the air discharge passage when the position of the directional control valve is changed and, therefore, the C ring clamping device generates large air discharge noise every time the directional control valve is operated to change the flow direction of air to deteriorate the working environment of a place where the C ring clamping device is used for clamping work using C rings.

SUMMARY OF THE INVENTION

Accordingly, it is an object of the present invention to provide a pneumatic device capable of operating without deteriorating the working environment of a place where the pneumatic device is used.

The present invention provides a pneumatic device, which comprises a main body provided with a second air discharge passage opening in a back portion of the main body, a grip joined to a lower portion of the main body and provided with a first air discharge passage, a pneumatic cylinder contained in the main body, a directional control valve contained in the main body and having a first discharge port connected to the first air discharge passage and a second discharge port connected to the second air discharge passage, and a tube having one end connected to the open end of the second air discharge passage and the other end connected to an end portion of the first air discharge passage near the first discharge port of the directional control valve.

In this pneumatic device, air is not discharged through the open end of the second air discharge passage near the operator and hence large air discharge noise is not generated near the operator when air is discharged, which contributes to maintaining a working environment of a place where the pneumatic device is operated in a satisfactory condition.

DETAILED DESCRIPTION OF THE INVENTION

Figure 1:
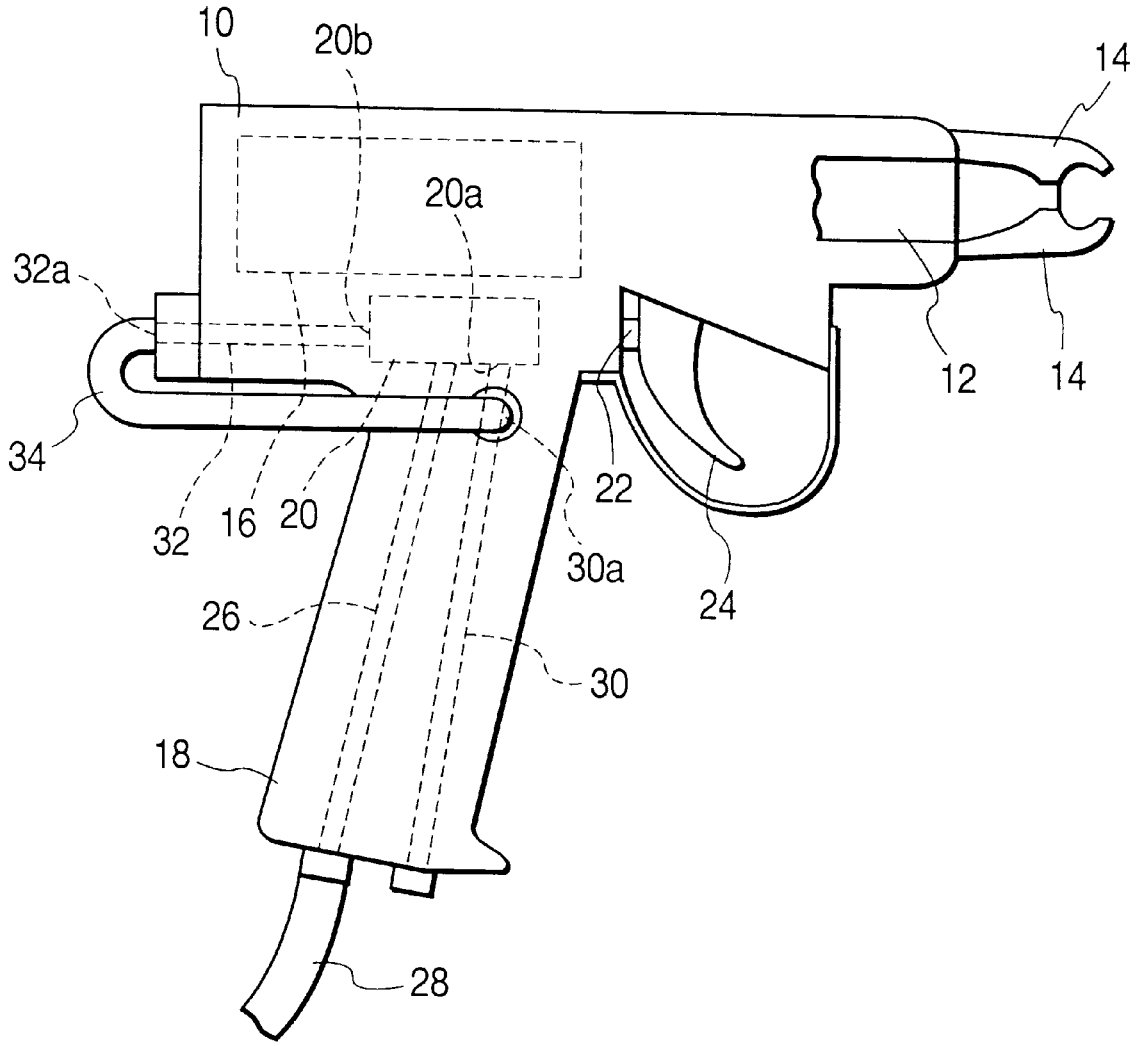
FIG. 1 is a schematic side view of a C ring clamping device in a preferred embodiment according to the present invention.
Figure 2:
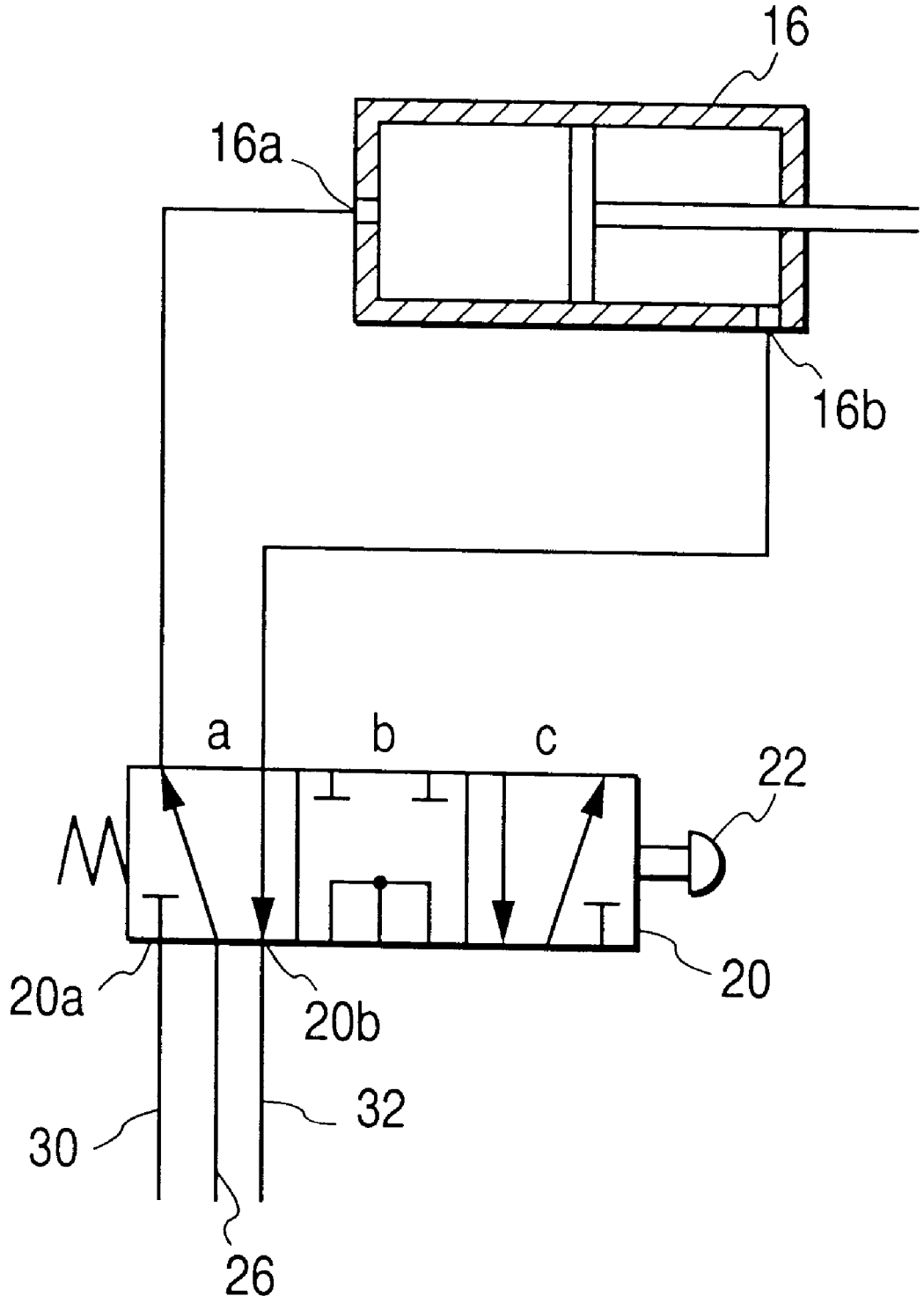
FIG. 2 is a circuit diagram of a pneumatic circuit for operating a pneumatic cylinder included in C ring clamping device of FIG. 1.

Referring to FIGS. 1 and 2, a C ring clamping device in a preferred embodiment according to the present invention has a main body 10 and a grip 18 joined to a lower portion of the main body 10. A magazine 12 loading C rings, not shown, is fixed to a portion of the main body 10 near a clamping head. The C rings are fed by a C ring feed mechanism, not shown.

Jaws 14 for deforming the C ring are held on the main body 10, and a pneumatic cylinder 16 for turning the jaws 14 is contained in the main body 10. A push-button directional control valve 20 provided with a push button 22 is contained in the main body 10 and is connected to the pneumatic cylinder 16. The push button 22 projects from the main body 10 and is operated by a trigger 24 supported on the main body 10.

An air supply passage 26 formed in the grip 18 has one end connected to an air feed port of the directional control valve 20 and the other end connected to an air tube 28 to be connected to a compressed air supply device, not shown. A first air discharge passage 30 is formed in the grip 18 so as to be connected to a first discharge port 20*a* of the directional control valve 20 and so as to open in the lower end, as viewed in FIG. 1, of the grip 18. A second air discharge passage 32 is formed in the main body 10 so as to be connected to a second discharge port 20*b* of the directional control valve 20 and so as to open in the back end, i.e., the left-hand end as viewed in FIG. 1, of the main body 10. The open end 32*a* of the second air discharge passage 32 is connected to an inner end portion 30*a*, i.e., a portion near the discharge port 20*a*, of the first air discharge passage 30 by a tube 34.

When the directional control valve 20 is set in a position a, the air supply passage 26 is connected to a port 16*a* of the pneumatic cylinder 16, and a port 16*b* of the pneumatic cylinder 16 is connected to the second air discharge passage 32. When the directional control valve 20 is set in a position b, the air supply passage 26 is connected to the air discharge passages 30 and 32. When the directional control valve 20 is set in a position c, the air supply passage 26 is connected to the port 16*b* of the pneumatic cylinder 16 and the port 16*a* of the pneumatic cylinder 16 is connected to the first air discharge passage 30.

In a state where the air tube 28 is connected to the compressed air supply device and the trigger 24 is not pulled, the directional control valve 20 is in the position a to supply compressed air from the compressed air supply device through the port 16*a* into the pneumatic cylinder 16, so that an piston rod of the pneumatic cylinder 16 is extended and the jaws 14 are opened. In this condition, when the trigger 24 is pulled, the position of the directional control valve 20 changes from the position a through the position b to the position c. Consequently, compressed air is supplied from the compressed air supply device through the port 16*b* into the pneumatic cylinder 16, so that the piston rod of the pneumatic cylinder is retracted. Consequently, the jaws 14 are closed to deform the C ring so that matters, not shown, to be clamped are clamped together with the C ring. When the trigger 24 is released, the position of the directional control valve 20 changes from the position c through the position b to the position a to supply compressed air from the compressed air supply device through the port 16*a* into the pneumatic cylinder 16, so that the piston rod of the pneumatic cylinder 16 is extended and the jaws 14 are opened. Thus, clamping is made.

When the trigger 24 is pulled to set the directional control valve 20 in the position c, air is discharged through the port 16*a* of the pneumatic cylinder 16 and the first air discharge passage 30.

When the trigger 24 is released to set the directional control valve 20 in the position a, air is discharged through the port 16*b* of the pneumatic cylinder 16, the second air discharge passage 32, the tube 34 and the first air discharge passage 30.

Thus, in the C ring clamping device, air is not discharged through the open end 32*a* of the second air discharge passage 32 nearer to the operator than the first air discharge passage 30, large air discharge noise is not generated near the operator and hence the condition of a working environment in which the C ring clamping device is used is improved.

Figure 3:
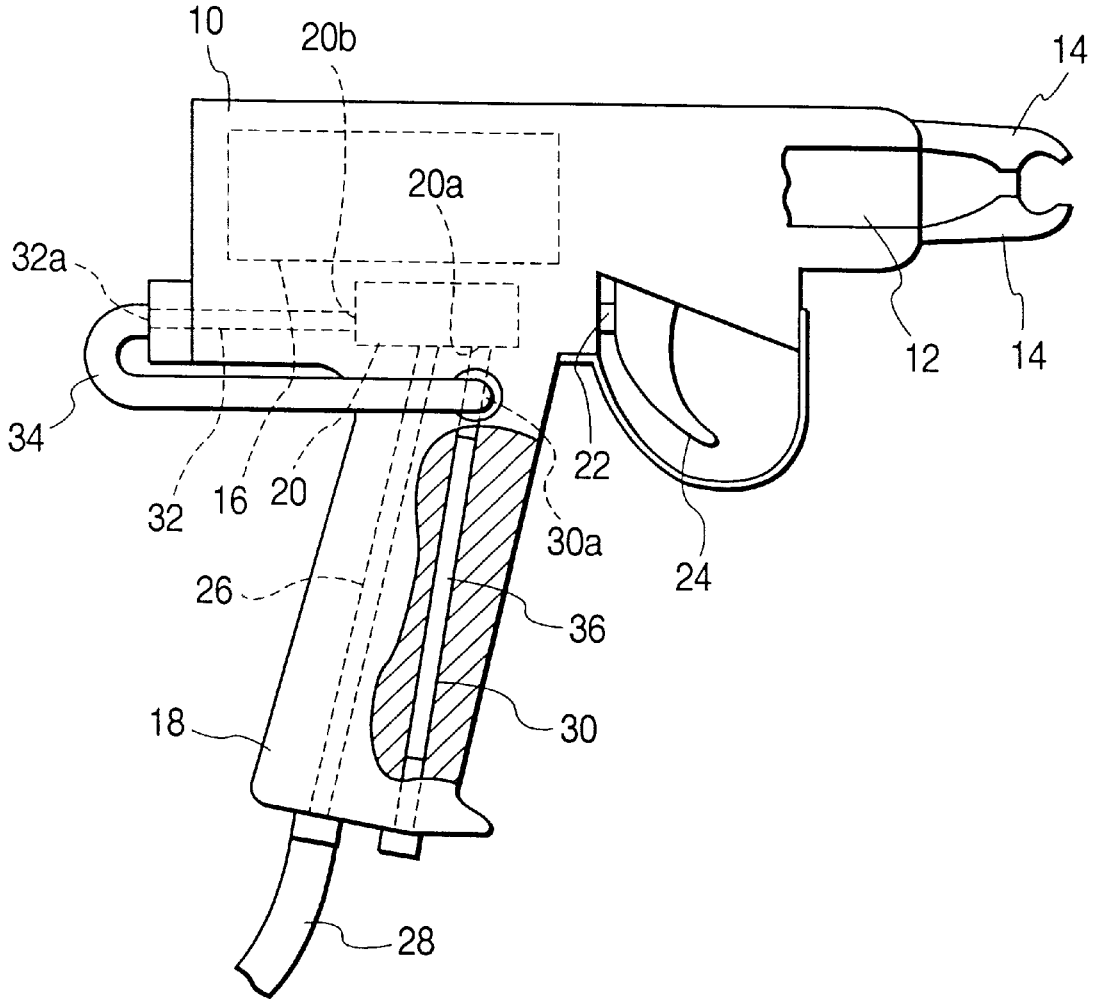
FIG. 3 is a schematic side view of a C ring clamping device in another embodiment according to the present invention.

Referring to FIG. 3 showing a C ring clamping device in another embodiment according to the present invention, a first air discharge passage 30 is packed with a sound absorbing material 36, such as glass wool or metal wool.

When a trigger 24 is operated to operate a directional control valve 20 included in the C ring clamping device, air is discharged through the first air discharge passage 30. Since the first air discharge passage 30 is packed with the sound absorbing material 36, large air discharge noise is not generated, so that the condition of a working environment in which the C ring clamping device is used can be improved.

Although the invention has been described as applied to the C ring clamping devices, obviously, the present invention is applicable to other pneumatic devices, such as other hog ring clamping devices.

What is claimed is:

1. A pneumatic device comprising:

a) a main body provided with a second air discharge passage opening in a back portion of said main body;

b) a grip joined to a lower portion of said main body and provided with a first air discharge passage;

c) a pneumatic cylinder contained in said main body;

d) a directional control valve connected to said pneumatic cylinder for controlling said cylinder and contained in said main body, and having a first discharge port connected to said first air discharge passage, and a second discharge port connected to said second air discharge passage; and e) a tube having one end connected to the open end of said second air discharge passage and the other end connected to an end portion of said first air discharge passage, near said first discharge port of said directional control valve.

2. The pneumatic device according to claim 1, wherein said first air discharge passage is packed with a sound absorbing material.

3. The pneumatic device according to claim 2, wherein said sound absorbing material is glass wool.

4. The pneumatic device according to claim 2, wherein said sound absorbing material is metal wool.

5. The pneumatic device according to claim 1, wherein said pneumatic device is a hog ring clamping device.

6. The pneumatic device according to claim 5, wherein said hog ring clamping device is a C ring clamping device.

* * * * *